US011407578B1

(12) United States Patent
Bouse et al.

(10) Patent No.: US 11,407,578 B1
(45) Date of Patent: Aug. 9, 2022

(54) DISPOSABLE BEVERAGE CONTAINER SLEEVE AND COASTER

(71) Applicants: Roy Q. Bouse, League City, TX (US); Lucas Drake Bouse, League City, TX (US)

(72) Inventors: Roy Q. Bouse, League City, TX (US); Lucas Drake Bouse, League City, TX (US)

( * ) Notice: Subject to any disclaimer, the term of this patent is extended or adjusted under 35 U.S.C. 154(b) by 0 days.

(21) Appl. No.: 17/331,415

(22) Filed: May 26, 2021

Related U.S. Application Data

(60) Provisional application No. 63/029,865, filed on May 26, 2020.

(51) Int. Cl.

| | |
|---|---|
| ***B65D 5/54*** | (2006.01) |
| ***B65D 81/38*** | (2006.01) |
| ***B65D 5/36*** | (2006.01) |
| ***A47G 23/02*** | (2006.01) |
| ***B65D 5/42*** | (2006.01) |

(52) U.S. Cl.
CPC ..... *B65D 81/3876* (2013.01); *A47G 23/02* (2013.01); *B65D 5/3621* (2013.01); *B65D 5/4216* (2013.01); *A47G 2023/0291* (2013.01)

(58) Field of Classification Search
CPC ..... B65D 81/3876; B65D 5/3621; B65D 5/4216; A47G 23/02; A47G 2023/0291
USPC ..... 220/738, 737, 739; 229/5.5, 403, 405, 229/117.06
See application file for complete search history.

(56) References Cited

U.S. PATENT DOCUMENTS

| | | | |
|---|---|---|---|
| 5,746,372 | A | 5/1998 | Spence |
| 6,059,140 | A | 5/2000 | Hicks |
| 6,290,091 | B1 | 9/2001 | Bell |
| 6,412,686 | B1 | 7/2002 | Mahl |
| 6,513,704 | B1 | 2/2003 | Perot |
| 8,627,872 | B2 | 1/2014 | Selina |
| 9,125,505 | B2 | 9/2015 | Morris |
| 9,302,815 | B2 | 4/2016 | Shaw et al. |
| 9,795,235 | B1 | 10/2017 | Bouse et al. |
| 10,364,086 | B1 | 7/2019 | Bouse et al. |
| 2002/0179617 | A1 | 12/2002 | Barthlow et al. |
| 2003/0111475 | A1 | 6/2003 | Cheng |
| 2005/0121457 | A1 | 6/2005 | Wilson et al. |
| 2006/0131315 | A1 | 6/2006 | DeGrazio |
| 2006/0283868 | A1 | 12/2006 | McDonald |
| 2007/0051736 | A1 | 3/2007 | Tavares |

(Continued)

FOREIGN PATENT DOCUMENTS

| | | | |
|---|---|---|---|
| GB | 2474858 | A | 5/2011 |
| WO | WO97/32797 | A1 | 9/1997 |

*Primary Examiner* — Don M Anderson
*Assistant Examiner* — Elizabeth J Volz
(74) *Attorney, Agent, or Firm* — Karen B. Tripp

(57) ABSTRACT

A unitary disposable beverage container sleeve that can also be used as a coaster and that can be comprised of (optionally recyclable) cardstock for economically imprinting with advertising logos or slogans. The upper body vertical rectangular edges are connected to form sides of the sleeve and a gusset extends across the diameter at the lower edge to form the base of the sleeve. The gusset has a hinge that opens and closes the sleeve. Arched grooves positioned at that lower edge above the gusset where the gusset attaches to opposing sides of the sleeve allows flex in the sleeve and affords a level base.

18 Claims, 8 Drawing Sheets

(56) References Cited

U.S. PATENT DOCUMENTS

| | | | | |
|---|---|---|---|---|
| 2007/0131742 | A1* | 6/2007 | Fitzwater ..... | B65D 75/5888<br>229/101.1 |
| 2007/0205204 | A1 | 9/2007 | Novak | |
| 2008/0041864 | A1 | 2/2008 | Wong | |
| 2008/0164270 | A1 | 7/2008 | Puerini et al. | |
| 2009/0242578 | A1 | 10/2009 | Bonilla | |
| 2013/0075412 | A1 | 3/2013 | Schminke | |
| 2015/0291313 | A1 | 10/2015 | Vara | |

* cited by examiner

DISPOSABLE BEVERAGE CONTAINER SLEEVE AND COASTER

CROSS REFERENCE TO RELATED APPLICATION

This application claims benefit of U.S. Ser. No. 63/029,865, filed May 26, 2020.

FIELD OF THE INVENTION

The present invention relates to the field of devices for holding a beverage container, and in particular to devices for shielding a user from temperature and condensate on the exterior of the beverage container.

BACKGROUND OF THE INVENTION

Many people enjoy cold beverages from a can or a bottle when they are travelling, attending or participating in a social activity, sporting event or some other activity. In some cases, it may not be convenient to find a cup or glass of ice to pour the beverage into. In other cases, beverages do not mix well with ice cubes, and sometimes, the quality of the ice may be in question. Still further, ice may not be readily available. People enjoying cold beverages often desire to shield their hands and/or fingers from the colder temperature of the beverage container and/or any condensate that may form on the beverage container in warmer and/or more humid ambient environments.

Several devices for insulating a hot or cold beverage are described in patent literature. For example, WO97/32797A1 (Norrish) describes a wrap that is rectangular in shape. In use, a beverage can is laid on its side and rolled on the top of a stack of wraps. A strip of adhesive tape at point of use is used to hold the wrap in place around the can.

Similarly, US20020179617A1 (Barthlow et al) describes a wrap-around device made from a water repellent styrene foam and an inner layer of an adsorbent material with an adhesive strip for holding the wrap in place.

US20070051736A1 (Tavares) and US20090242578A1 (Bonilla) likewise describe an insulator for a chilled beverage container. The Tavares insulator is formed of two layers with a plurality of air-filled cavities between the layers. The insulator is wrapped around a container, though it is not clear if the insulator is affixed in position. The Bonilla insulator has a multilayer paper towel-like material with an exterior thin metallic foil layer.

And US20150291313A1 (Vara) illustrates a rectangular wrap with an overlapping tab portion for applying adhesive.

U.S. Pat. No. 5,746,372A (Spence) describes a beverage holder made of water soluble starch based material for holding a beverage cup, for example a cup containing hot coffee. The holder is arcuate in shape to accommodate a cup that has a tapered diameter. The holder has a tab on one side and a slot for receiving the tab on the other side.

Likewise, US20050121457A1 (Wilson et al) and US20080164270A1 (Puerini et al) describe frusto-conical shaped wraps for adsorbing and/or collecting condensate from the outside of a beverage container.

All of devices described above have no bottom section and most of the devices require either the person using the wrap or a person serving the beverage to manipulate the wrap at the point of use for sealing it around the beverage container.

US20060131315A1 (DeGrazio) describes a sheath made from a paper-like fiber that is pressed into a cylindrical shape with pleated sides. An elastic or fixed rim is formed at the top for folding over the top and affixed in place with adhesive.

Similarly, US20070205204A1 (Novak) shows a pleated cuff with a top edge for catching drips, spills or condensation.

US20130075412A1 (Schminke) describes an insulated wrap around sleeve with a built-in coaster for adding structure and stability to the insulated drink sleeve.

U.S. Pat. No. 6,290,991B1 (Bell) relates to a collapsible beverage container holder made from a die-cut sheet of recycled pressed paper pulp. The holder has a large rectangular side portion and a small rectangular side portion connected by a substantially circular bottom portion having flanges connecting to the respective opposing rectangular sides. The large rectangular side has opposing side flaps for folding around and affixing to the small rectangular side, for example with adhesive.

Similarly, GB2474858A (Jones) describes a blank of insulated paper-based material with a central circular section and a pair of opposing wings, one wing having flaps for folding and adhering to the other wing section.

And U.S. Pat. No. 9,302,815B2 (Shaw et al) relates to a paper wrap for a wine bottle. The wrap has a bottom strip attached to the main wrap body to allow for inspection of the contents of the bottle without removing the main wrap body.

In a similar approach, US20060283868A1 (McDonald) relates to a beverage container accessory made from a pliable material. A sheet of material is cut into first and second square sections that are affixed with adhesive. Once affixed, the accessory is imprinted with a logo or promotional material.

U.S. Pat. Nos. 9,795,235 and 10,364,086, by the inventors named in the present application, describe one-piece disposable beverage container sleeves stronger than the disposable beverage container sleeves of the prior art, and capable of being produced with less waste and torn sleeves than those of the prior art. The sleeves disclosed in these patents have unique gussets that underlie the base of the beverage container. While useful, the gussets in these sleeves surprisingly do not provide a base as flat and level as desired when beverage containers are positioned within the sleeves.

While a number of devices for insulating a hot or cold beverage have been described in the patent literature and a number of such devices are commercially available, there remains a need for a low-cost device that can be readily implemented by a user or a person serving a beverage to a user, that is flexible for conforming to the diameter of the beverage container and that provide a flat, level base on which the beverage container can rest.

SUMMARY OF THE INVENTION

The present invention provides a beverage container sleeve that is disposable, and sufficiently economical to make that it can be imprinted for "give-away" advertising, and functional not only as a beverage container sleeve but also as a coaster. This disposable sleeve can be advantageously made with readily available and even recyclable materials such as card stock, and is designed to have a bottom that sits flat or level beneath a beverage container.

The disposable sleeve of the invention has a substantially rectangular upper body that comprises a vertical upper body fold line and an integrated upper body flap along a full length of a first vertical edge of the upper body. This upper body flap folds under and connects or affixes to the back of a second vertical edge of the upper body so that the first vertical edge of the upper body is proximate or adjacent to the second vertical edge of the upper body, forming a cylindrical or somewhat cylindrical sleeve.

A "gusset" expands across the base of this sleeve when the sleeve is in use, to provide a base on which the beverage container rests when inserted into the sleeve. The gusset comprises a first gusset portion and a second gusset portion integrated with and depending from a lower edge of the upper body on opposing sides of the vertical upper body fold line. In one embodiment, the first gusset portion and the second gusset portion each have a vertical length approximately equivalent to the interior diameter of the sleeve when the first vertical edge of the upper body is proximate the second vertical edge of the upper body and the sleeve is open.

To complete the gusset, the first gusset portion and the second gusset portion, each having a part proximal the lower edge of the upper body and a part distal the lower edge of the upper body, are affixed together. That is, the proximal part of the first gusset portion and the proximal part of the second gusset portion each fold under or behind the lower edge of the upper body, and the distal part of the second gusset portion is further folded along a horizontal fold line between that distal part of the second gusset portion and the proximal part of the second gusset portion for connecting or affixing that distal part of the second gusset portion to the distal part of the first gusset portion.

Connecting or affixing the folded distal part of the second gusset portion to the distal part of the first gusset portion effects a hinge for opening and closing the sleeve, such that when the hinge is open, the gusset can lay flat or generally flat or level between the sides of the upper body and beneath a beverage container inserted in the disposable beverage container sleeve, and when the hinge is closed the disposable beverage container sleeve can lay flat or generally flat for use as a coaster for a beverage container.

The lower edge of the upper body of the sleeve has first and second arched grooves respectively above the first and second gusset portions, which enables or facilitates flex in the upper body so that the gusset can provide a level base for the beverage container.

In one embodiment the sleeve has pinch lines on either side of the vertical upper body fold line for adjusting the diameter of the open sleeve for easier accommodation of beverage containers of different widths or diameters.

When the upper body flap is affixed to the upper body proximate the second vertical edge, and the gusset is formed and the hinge is open, the disposable beverage container sleeve is laterally continuous from the first vertical edge of the upper body to the vertical upper body fold line to the second vertical edge of the upper body, and longitudinally continuous from an upper edge of the upper body to the lower edge of the upper body through the proximal part of the first gusset portion to the proximal part of the second gusset portion to the lower edge of the upper body to the upper edge of the upper body.

BRIEF DESCRIPTION OF THE DRAWINGS

The present invention will be better understood by referring to the following detailed description of preferred embodiments and the drawings referenced therein, in which.

DESCRIPTION OF THE INVENTION

The present invention meets the need for a disposable sleeve for a beverage container that is economical to construct and that can be comprised of an optionally recyclable, inexpensive, card stock or cardboard which can be easily imprinted, stamped, embossed, or have a label affixed thereto with various promotional messages, logos, and the like for advertising purposes and uses, for non-limiting example as for hand-outs at sporting, athletic, or other entertainment venues, and at corporate meetings, in gimme-packs at conventions, and in restaurant and other business promotions, and the like. The disposable sleeve of the invention lays flat or relatively flat when not in use and can be used for a coaster underneath a beverage container as well.

The present invention provides a disposable sleeve and coaster for a wide variety of beverage containers, including, without limitation, cans, glass bottles, metal bottles, plastic bottles, and the like. The disposable sleeve shields a user holding the beverage container from condensation that may occur when a cold or cool beverage container encounters a warmer and/or more humid ambient environment and forms condensation. Similarly, when used as a coaster, the present invention protects a table from such condensation. The disposable sleeve also provides a buffer from a cooler temperature of a beverage container. This is particularly advantageous in a social setting where a user holding a beverage container may wish to shake hands or touch another person, without the embarrassment of cold and/or wet hands and/or fingers.

Furthermore, the disposable beverage container sleeve of the present invention is easy and quick to open and use and can be produced with less waste and less adhesive and fewer torn sleeves, when compared to prior art sleeves.

The disposable sleeve of the invention is advantageously produced from a paper. The selection of type of paper can be determined by the skilled in the art in view of a number of preferred characteristics including, without limitation, absorbency, strength, recyclability, texture, color, projected/desired number of uses before disposal, and the like, without departing from the spirit of the present invention. The paper may be a multi-ply or multilayer paper in combination with foil, plastic, an adsorbent, and the like, without departing from the spirit of the present invention.

Figure 1:
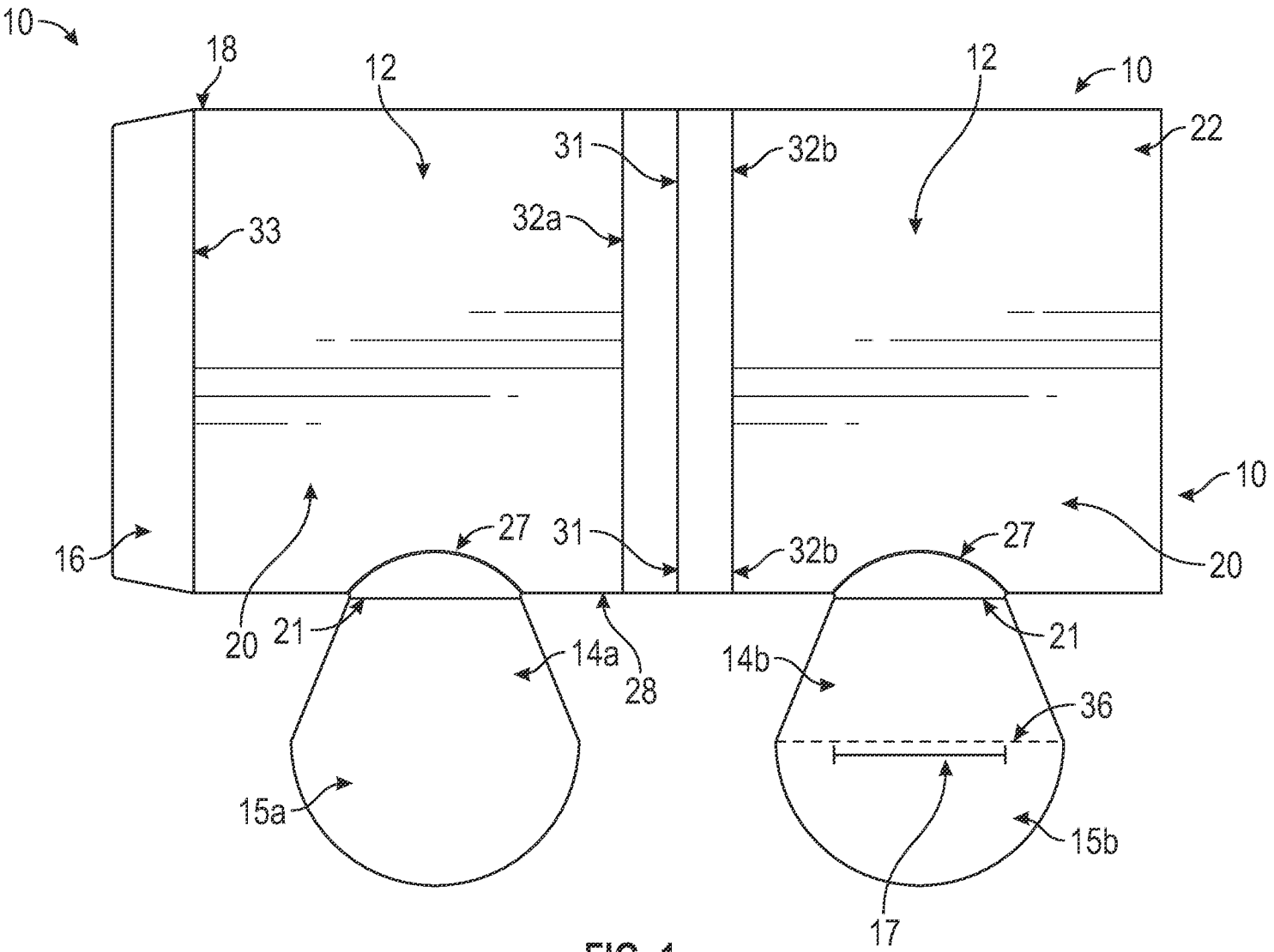
FIG. 1 is a front or top view of a workpiece prior to assembly for making one embodiment of a disposable sleeve for a beverage container of the present invention.

Referring now to the drawings in order to more fully appreciate the disposable sleeve 10 of the present invention, FIG. 1 illustrates a workpiece for making effectively two embodiments. That is, Figures precisely illustrate two embodiments of the invention but these particular embodiments are the same except that the embodiment of FIGS. 1, 2, 8, 9, and 10 provides for an optional flap 38 to provide for expansion of the width or diameter of the disposable sleeve. Even in this embodiment the flap 38 is only optionally implemented, and when not used, this embodiment is like the other embodiment. Thus, other than the further discussion about that particular flap 38, the discussion herein and all of the drawings have general applicability to both embodiments. And as will be discussed further, the disposable sleeve of the invention is not limited to these illustrated embodiments, but can be fully understood from these illustrated embodiments.

Figure 10:
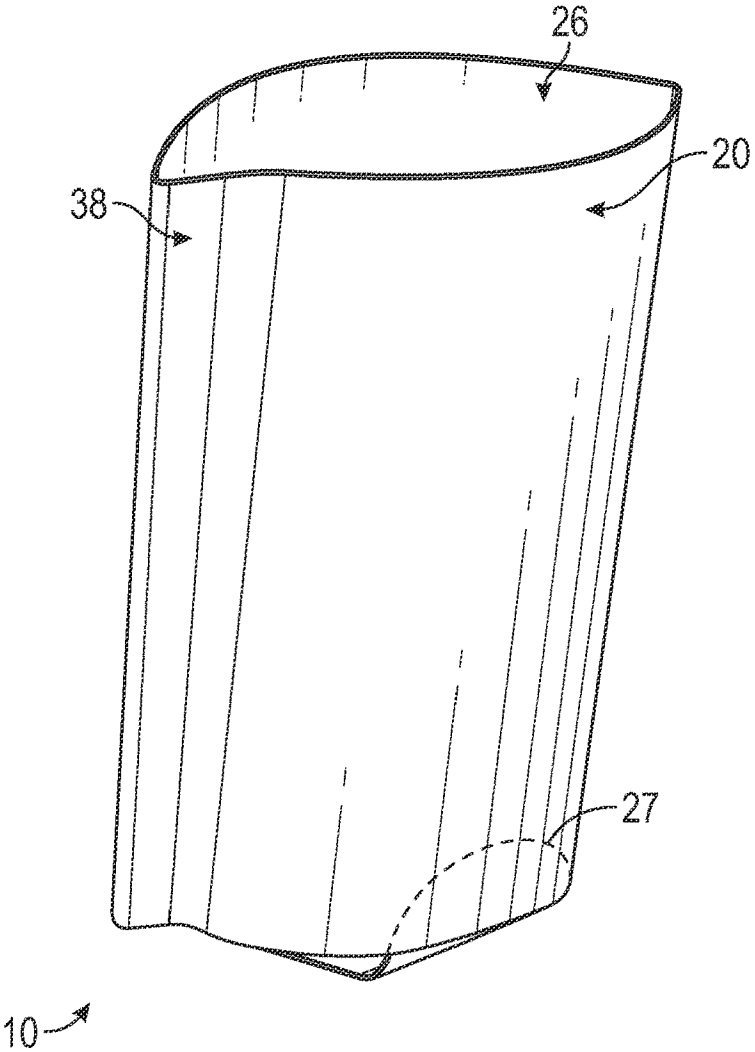
FIG. 10 is another side perspective view of the disposable sleeve for a beverage container of FIGS. 1 and 9, open in part, or mostly open, but not yet in use with a beverage container.
Figure 11:
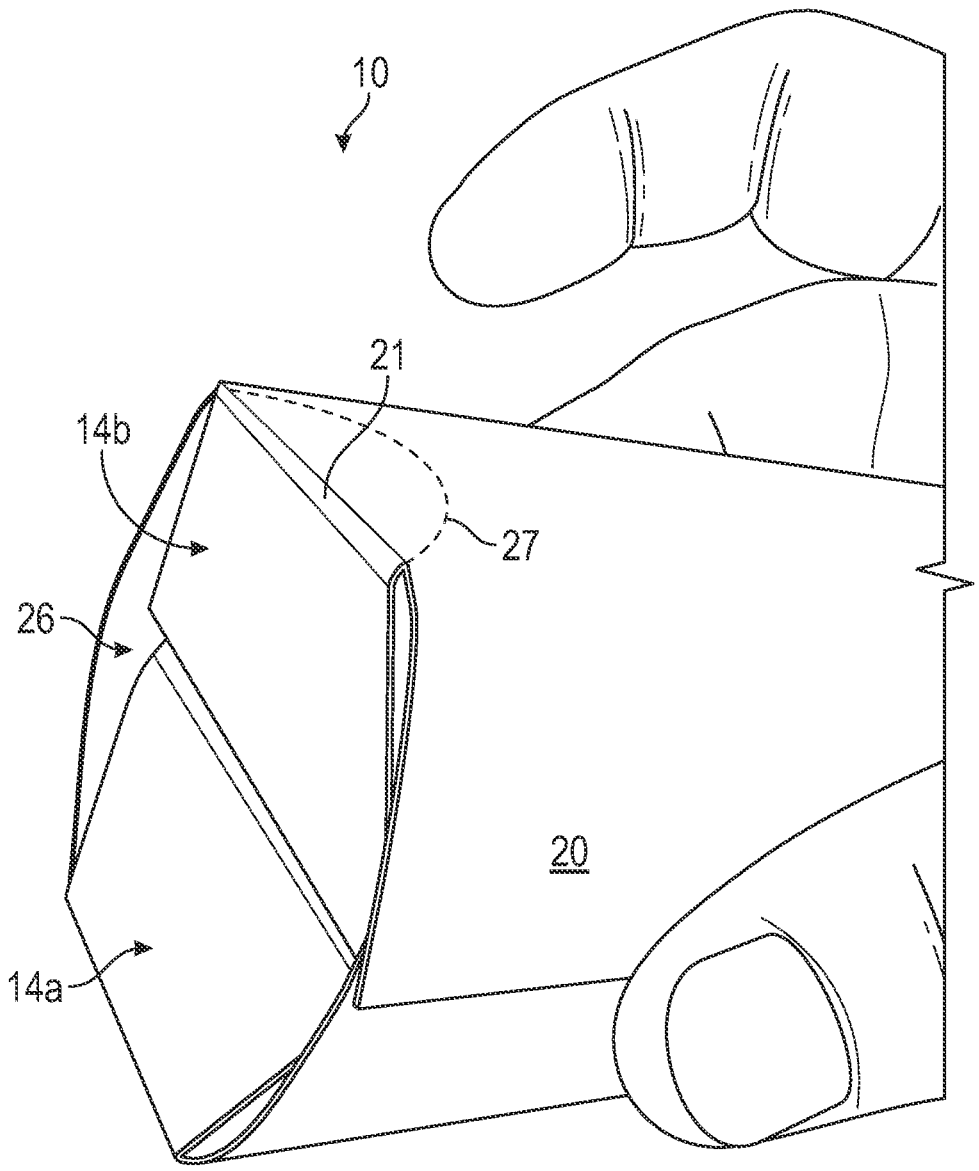
FIG. 11 is a bottom side perspective view of the disposable sleeve of FIG. 3-7, showing the gusset of the disposable sleeve.
Figure 12:
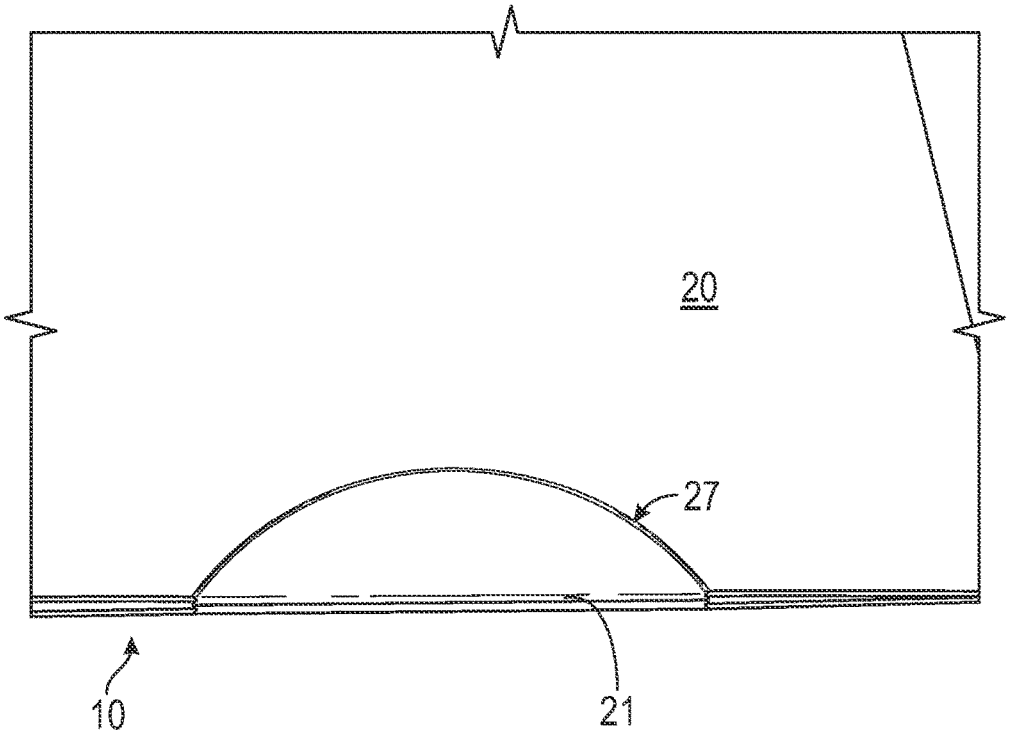
FIG. 12 is a close-up view of a groove above the gusset and in a lower edge of the upper body of a disposable sleeve for a beverage container of the present invention.

The disposable sleeve 10 of the FIGS. 1-13 has an upper body 12 which is cylindrical or somewhat cylindrical and a gusset base comprised of two connected or affixed pieces or portions 14*a* and 14*b* extending from one side of the upper body 12 to the other. A first and second arched groove 27, shown in enlarged view in FIG. 12, in the upper body 12 near the lower edge 28 of the upper body 12 above the fold line 21 for gusset portions 14*a* and 14*b* allows flex in the upper body 12 which enables the gusset base to be generally flat or level when in use underlying a beverage container in the sleeve, as shown in FIG. 11.

Figure 2:
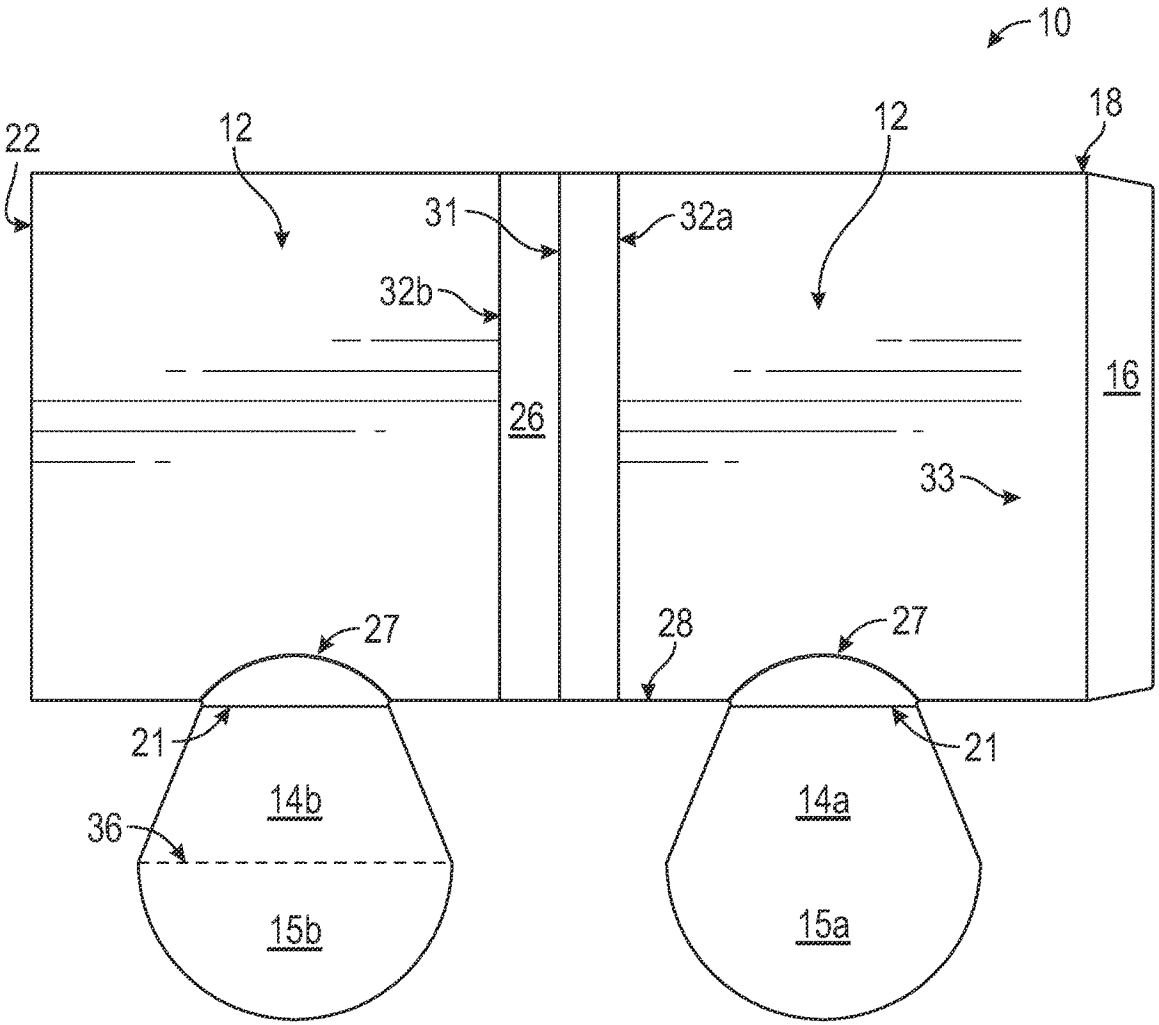
FIG. 2 is a back, or bottom (or underside) view of the workpiece of FIG. 1.

Before construction or assembly, as shown in FIGS. 1 and 2, the upper body 12 is substantially rectangular in shape and has an integrated flap 16 for affixing vertical sides of the upper body 12 together to form a somewhat cylindrical upper body 12. The flap 16 shown in FIGS. 1 and 2 is trapezoidal in shape. It will be understood that other shapes, rectangular for non-limiting example, are possible as discussed more fully below with respect to other embodiments of the disposable sleeve 10 not shown.

As shown in FIGS. 1 and 2, the workpiece for the disposable sleeve of the invention, or the disposable sleeve 10 unassembled, is a unitary structure. The gusset of the disposable sleeve however is formed of two distinct gusset portions, a first gusset portion and a second gusset portion, extending from a lower edge 28 of the upper body 12, each having a part or end proximal the upper body 12, numbered respectively 14*a* and 14*b*, and each having a part or end distal the upper body 12, numbered respectively 15*a* and 15*b*.

Figure 5:
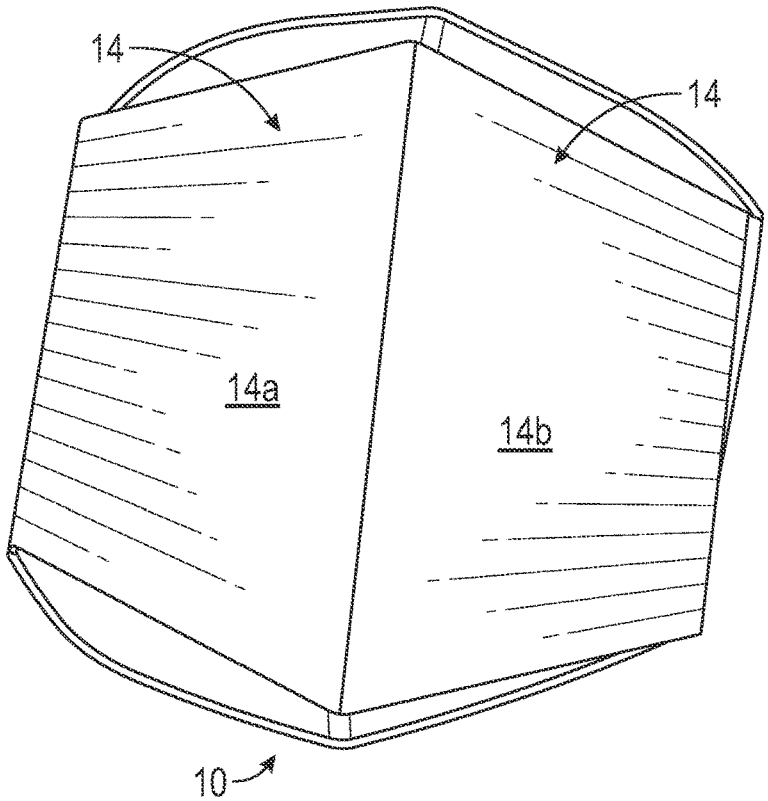
FIG. 5 is a bottom view of the opened disposable sleeve of FIGS. 3 and 4.

As shown in FIGS. 1 and 2, first gusset portion consisting of parts 14*a* and 15*a*, and second gusset portion consisting of parts 14*b* and 15*b*, are each an irregular shape with the proximal part being trapezoidal and the distal part being semicircular. In alternative embodiments of the disposable sleeve of the invention not shown, the first and second gusset portions could be shaped differently than the ones shown in the Figures. Having the proximal portions trapezoidal results in a hexagonal base for the disposable sleeve as shown in FIGS. 5 and 11. However, other shapes could alternatively be used provided that the shapes result in the proximal portions forming a base that is effective for spanning the diameter of the sleeve, and the distal portions effectively forming a hinge with the proximal portions as will be discussed below, and not interfering with the ability of the base to be level when a beverage container is positioned in the sleeve.

In FIGS. 1 and 2, the first and second gusset portions are the same size and shape. Alternative embodiments of the disposable sleeve of the invention are contemplated where there may be variations in such size and shape, which can still be effective provided a level base can still be formed for the disposable sleeve and provided the hinge noted above and that will be discussed further below can also still be formed. In another embodiment, not shown, the first and second gusset portions can be separate pieces from (but adjoined to) the upper body 12.

The second gusset portion has a fold line 36 between the proximal part 14*b* and the distal part 15*b*, and the distal part 15*b* has a glue line 17 below but near the fold line 36. In an alternative embodiment of the disposable sleeve of the invention not shown, the first gusset portion, instead of the second gusset portion, has a fold line 36 between the proximal part 14*a* and the distal part 15*a* and the distal part 15*a* has a glue line 17 below but near the fold line 36. That is, one of the two gusset portions has a fold line, the other doesn't, as will be seen in the discussion of the assembly below, one gusset portion is folded and the other gusset portion is not folded, but as to which one gusset portion is folded is not critical to the function of the design.

Further, in an alternative embodiment not shown, the glue line 17 can be on the unfolded first gusset portion, instead of the folded second gusset portion, but located in a similar position as shown on the folded gusset portion—that is, located in the distal part of the gusset portion but near the proximal part of the gusset portion. Only one glue line is needed on the gusset, but as to which gusset portion is not critical to the design. However, the glue line is on the front or top side of the gusset portion, as shown in FIG. 1, FIG. 1 showing the top side of the workpiece or unassembled disposable sleeve and FIG. 2 showing the bottom or underside of the workpiece or unassembled disposable sleeve.

Figure 3:
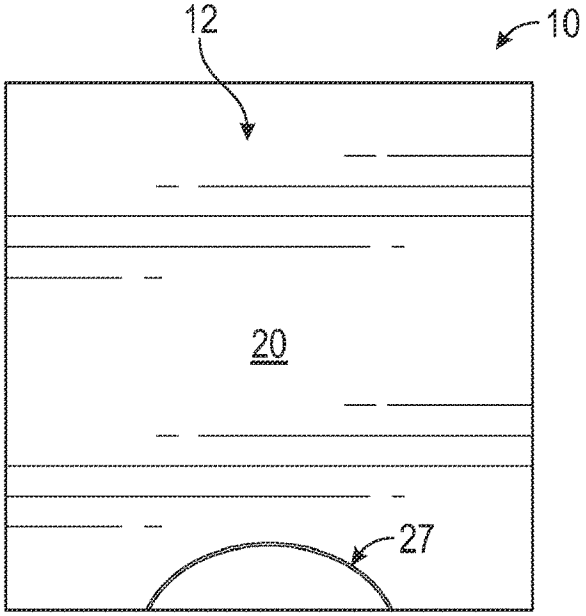
FIG. 3 is a side view of an alternative embodiment of a disposable sleeve for a beverage container of the present invention, assembled but closed and laid flat for use as a coaster for a beverage container, until (if desired) a user opens it for receipt of a beverage container for use as a sleeve for the beverage container.
Figure 8:
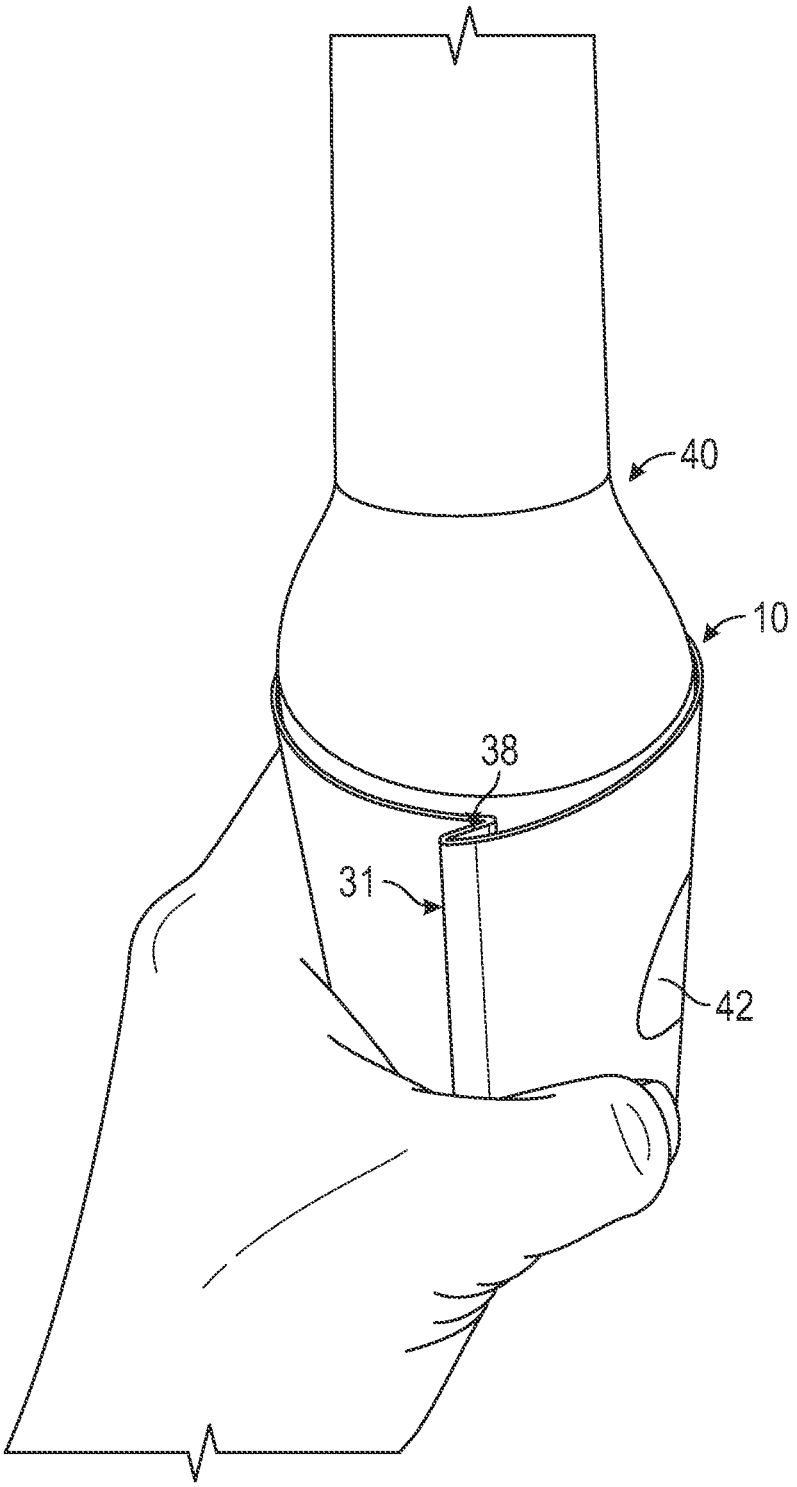
FIG. 8 is a top side perspective view of the disposable sleeve for a beverage container of FIG. 1, assembled and in use around a beverage bottle.
Figure 9:
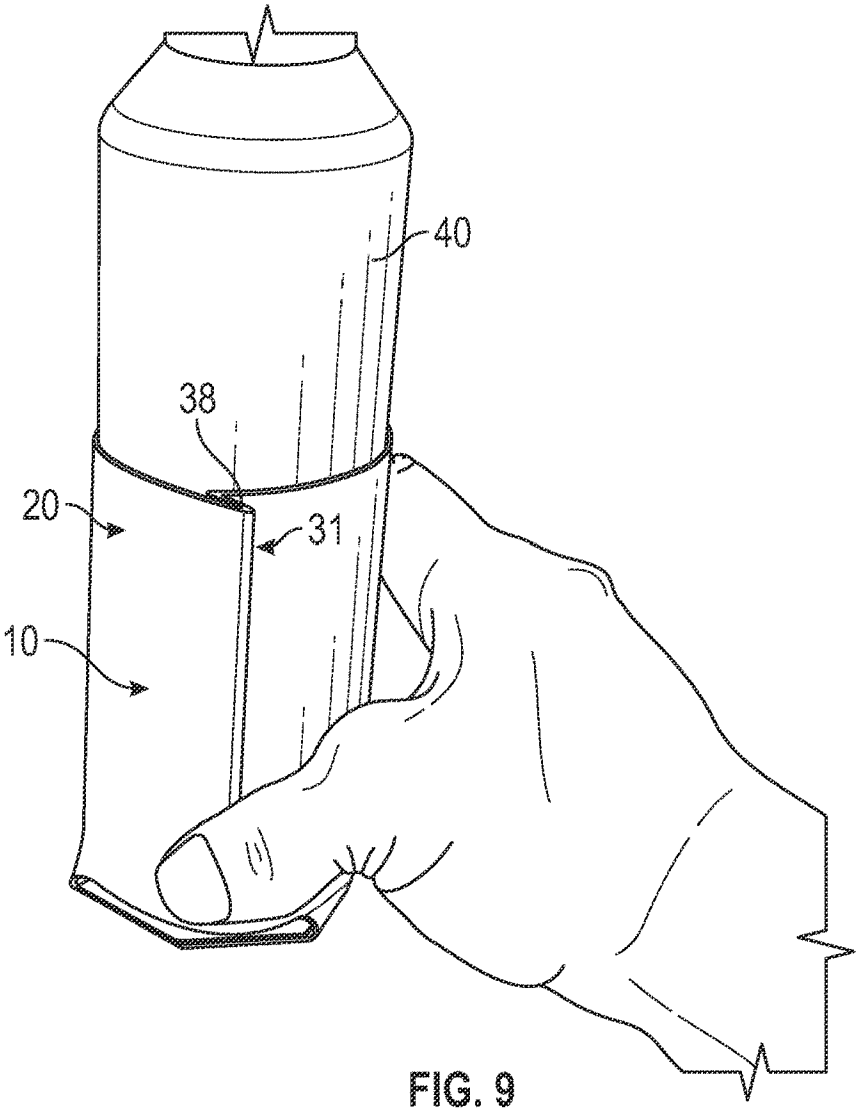
FIG. 9 is a side perspective view of another disposable sleeve for a beverage container of FIG. 1, assembled and in use around a beverage can, with the expansion flap folded in a different direction than for the disposable sleeve shown in FIG. 8.

Referring again to FIGS. 1 and 2, for assembly, the disposable sleeve of the present invention 10 is assembled by folding the upper body 12 along vertical upper body fold line 31. The flap 16 at the first vertical end 18 is folded back along flap fold line 33. The front side of flap 16 is preferably affixed to the back or internal side 26 of the upper body 12 at or along the second vertical end 22 with an adhesive, for example, with glue, in the form of dots or strips, an adhesive strip, double-sided tape or the like, such that the flap fold line 33 abuts or is adjacent to the vertical edge of the second vertical end 22. It will be understood that the type of adhesive may be selected in view of the material of construction of the disposable sleeve 10, the manufacturing process, and the like, without departing from the spirit of the present invention. Other affixing processes may also be used without departing from the spirit of the present invention. Once so affixed, the upper body 12 will have a cylindrical or a somewhat cylindrical shape when opened as shown in FIGS. 8, 9, 10, or a flat rectangular or square shape when closed, as shown in FIG. 3.

Figure 4:
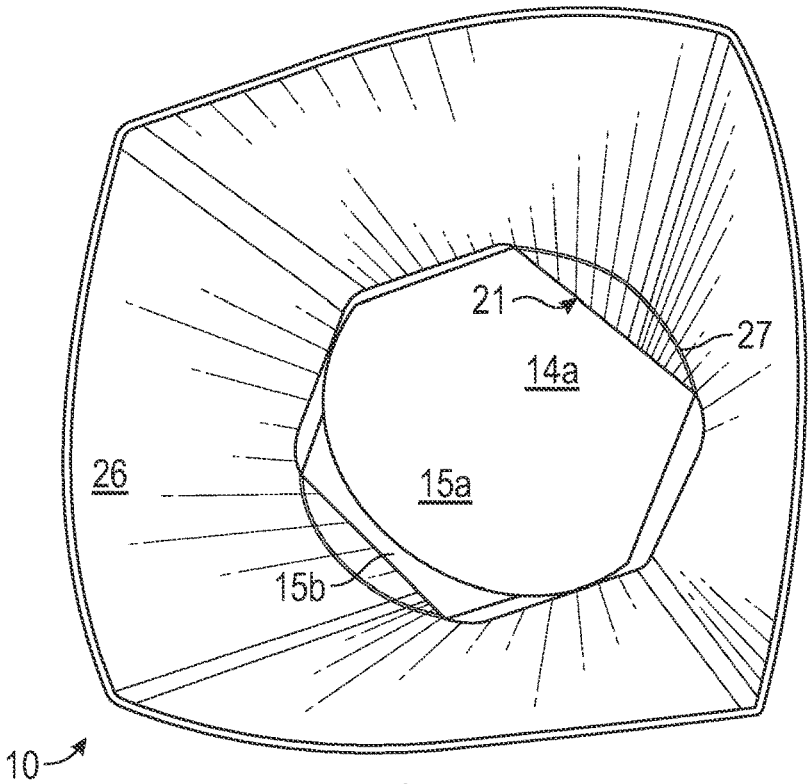
FIG. 4 is a top view of the disposable sleeve of FIG. 3, opened for receiving a beverage container.
Figure 6:
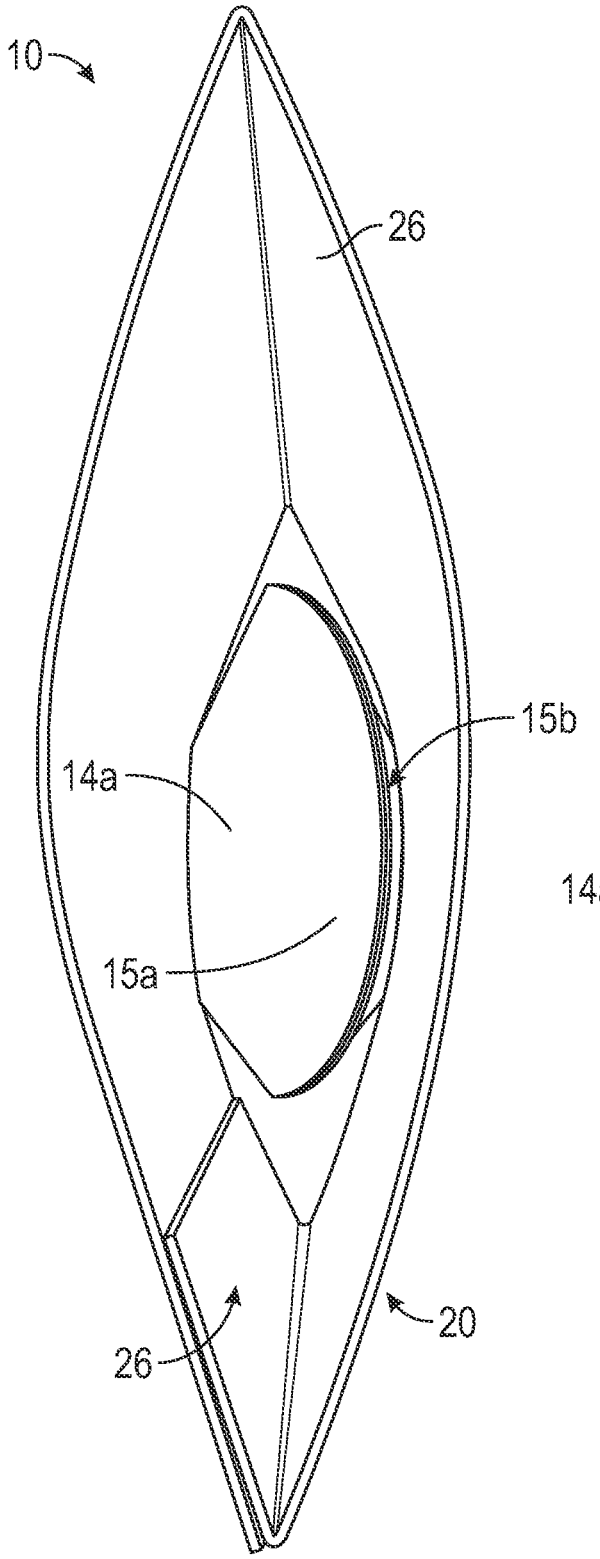
FIG. 6 is a top view of the disposable sleeve of FIG. 3, partially open but not fully open to receive a beverage container.
Figure 7:
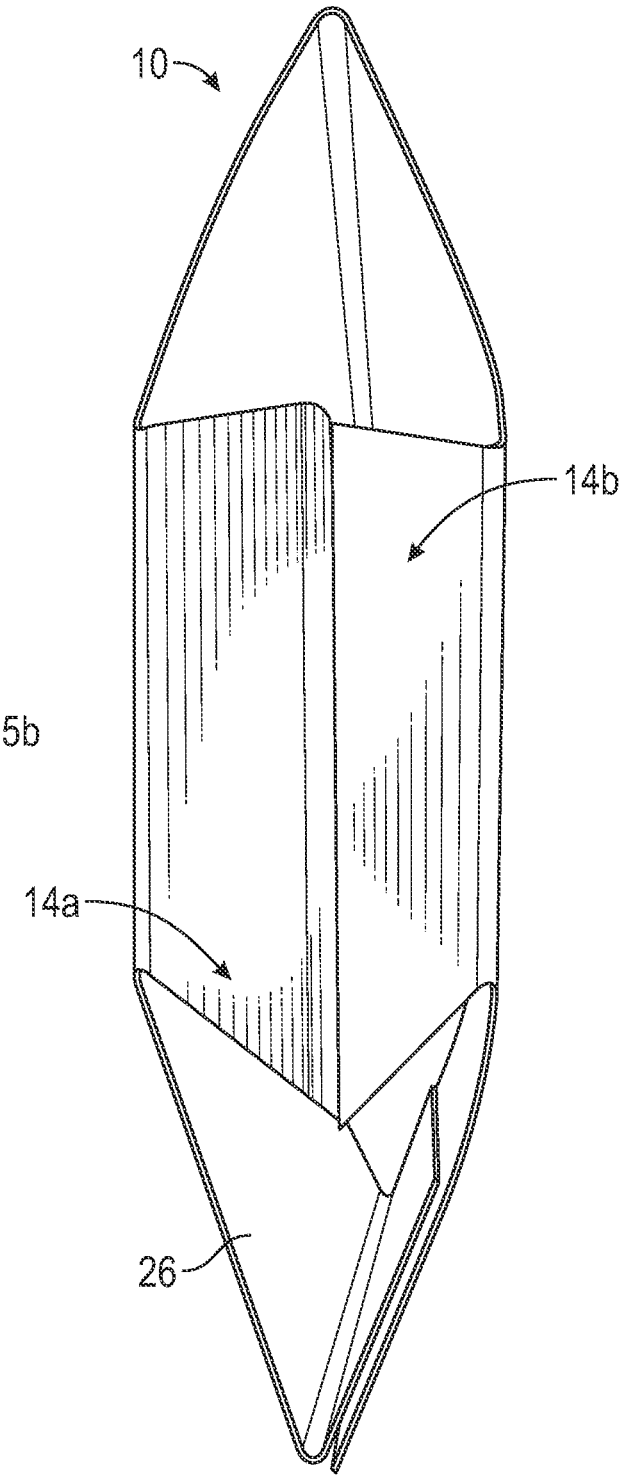
FIG. 7 is a bottom view of the not fully open disposable sleeve of FIG. 6.
Figure 13:
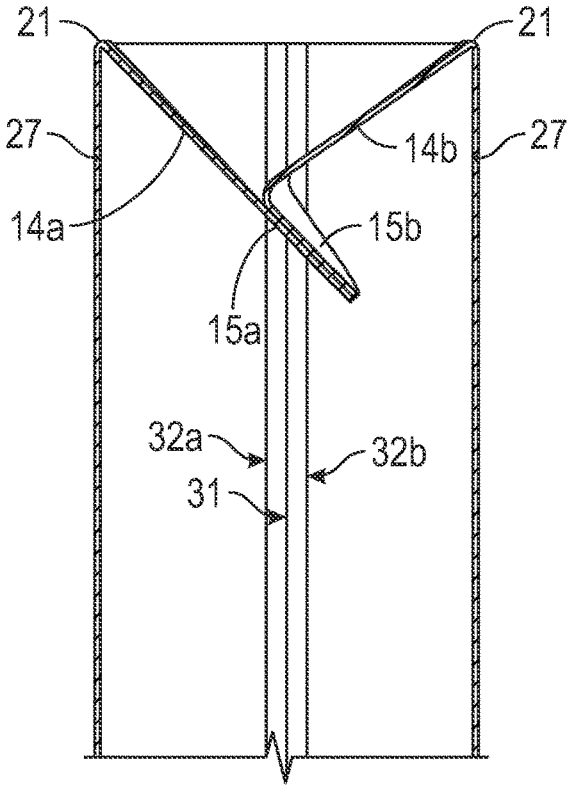
FIG. 13 is a vertical slice of the lower interior portion of a disposable sleeve for a beverage container of the present invention, inverted so that the gusset is at the top of the Figure, and showing the hinge of the gusset in the partially open position.

Further with respect to the assembly of the disposable sleeve 10, the gusset comprised of first and second gusset portions having respective proximal parts 14*a* and 14*b*, is formed by folding the distal part 15*b* of the second gusset portion back and affixing the front side 20 of that folded distal part 15*b* to the front side 20 of the distal part 15*a* of the first gusset portion, which is not folded, between the proximal part 14*a* and the distal part 15*a*. To enable this connection between the distal parts 15*a* and 15*b* of the respective first gusset portion and the second gusset portion, the first gusset portion and the second gusset portion are each folded back at line 21 along a lower edge 28 of the upper body 12 such that the front side 20 of proximal parts 14*a* and 14*b* remain on the front side 20 or exterior side of the disposable sleeve 10 as shown in FIGS. 5 and 11 and the back side of the first and second gusset portions are in the interior 26 side of the disposable sleeve 10, as shown in FIGS. 4 and 6. In this manner, the first and second gusset portions form a hinge, as shown in FIG. 13 as well as in FIGS. 4 and 6, which opens and closes the disposable sleeve 10.

Distal part 15*b* of the second gusset portion is preferably affixed to the distal part 15*a* of the first gusset portion with an adhesive along glue line 17, for example, with glue, in the form of dots or strips, an adhesive strip, double-sided tape or the like. As previously noted, it will be understood that the type of adhesive may be selected in view of the material of construction of the disposable sleeve 10, the manufacturing process, and the like, without departing from the spirit of the present invention. Other affixing processes may also be used without departing from the spirit of the present invention.

When the upper body flap 16 is affixed to the upper body 12 proximate the second vertical edge 22, and the gusset from gusset portions 14*a* and 14*b* is formed and the hinge is open (or in other words the gusset portions 15*a* and 15*b* are hingedly connected), the disposable beverage container sleeve is laterally continuous from the first vertical edge of the upper body to the vertical upper body fold line to the second vertical edge of the upper body, and longitudinally continuous from an upper edge of the upper body to the lower edge of the upper body through the proximal part of the first gusset portion to the proximal part of the second gusset portion to the lower edge of the upper body to the upper edge of the upper body.

Advantageously, the disposable beverage container sleeve 10 of the present invention can accommodate different diameter beverage containers, for example ranging in diameter from 2.25 inches to 2.75 inches. The disposable beverage container sleeve 10 may be sized to accommodate only one size of beverage container, or sized to accommodate a majority of beverage container sizes. With the materials of construction provided herein, the disposable beverage container sleeve 10 may be shaped by the user or server around various configurations and diameters of beverage containers without much effort, simply by gripping the beverage container encased in the disposable beverage container sleeve 10 of the present invention.

One embodiment of the invention, particularly shown in FIGS. 1, 2, 8, 9, and 10, has vertical upper body pinch lines or creases 32*a* and 32*b* on either side of vertical upper body fold line 31. These vertical upper body pinch lines or creases 32*a* and 32*b* on each side of the vertical upper body fold line 31, optionally can be folded or pinched creating fold-over flap 38, as shown in FIGS. 8, 9, and 10, for a tighter fit around thinner or smaller diameter bottles or cans. In other words, this folding or fold-over flap 38 may be effected or made by pinching together first "pinch" line or crease 32*a* and second "pinch" line or crease 32*b* on either side of the upper body fold line 31—that is line 31 is between crease 32*a* and crease 32*b*—and then folding the pinched or fold-over flap 38 against the side of the sleeve, as shown in FIGS. 8 and 9.

An advantage of the disposable sleeve of the present invention is that it provides an affordable marketing or promotional device. FIGS. 8 and 9 illustrate the embodiment of the disposable beverage container sleeve 10 in use around a beverage container (bottle or can) 40. In the embodiment shown in FIG. 8, the disposable beverage container sleeve 10 further comprises a marketing logo 42 incorporated in or on the upper body 12. The marketing logo 42 may be selected from the group consisting of logos symbolizing: an event, an association, an organization, a team, a school, a manufacturer, a producer, a supplier, a purveyor, a cause; goods made or sold by a manufacturer, a producer, a supplier, or a purveyor; and services provided by a manufacturer, a producer, a supplier, or a purveyor; and combinations thereof. The marketing logo 42 may be incorporated in or on the upper body and/or the gusset by imprinting, stamping, embossing, affixing a label, and combinations thereof. Various inks may be used depending on the material of construction and desired effect. For example, it may be preferred to use an ink that will not bleed or come off on the user's or server's hands. It may also be desirable to select an ink that changes color or becomes visible in response to temperature or humidity.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) that the applicant is entitled to claim, or the only manner(s) in which the invention(s) may be claimed, and the appended claims do not necessarily indicate that all recited features are necessary.

APPENDIX—LIST OF ELEMENTS

One embodiment of the beverage container sleeve and coaster of the invention

10 Upper body
14*a* First proximal part of first gusset portion of gusset
15*a* First distal part of first gusset portion of gusset
15*a* Second proximal part of second gusset portion of gusset
15*b* Second distal part of second gusset portion of gusset.
16 First vertical end flap
17 Glue line
18 First vertical end
20 External side of sleeve
22 Second vertical end
26 Internal side of sleeve
27 Groove
28 Lower edge of the upper body
31 Upper body fold line

32*a* and 32*b* First and Second upper body pinch lines or creases for (optional) fold-over flap 38 to adjust diameter of sleeve

33 First flap fold line for first flap 16

36 Horizontal fold line between second proximal part of second gusset portion and second distal part of second gusset portion

38 Fold-over flap to adjust diameter of sleeve (optional)

40 Beverage container (bottle or can)

42 Marketing logo

We claim:

1. A disposable beverage container sleeve, comprising:

a substantially rectangular upper body having a vertical upper body fold line and an integrated upper body flap along a full length of a first vertical edge of the upper body, the upper body flap adapted to fold under or behind a second vertical edge of the upper body, the upper body flap further adapted to be affixed to the upper body such that the first vertical edge of the upper body is proximate the second vertical edge of the upper body;

a gusset comprising a first gusset portion and a second gusset portion, the first and second gusset portions integrated with and depending from a lower edge of the upper body on opposing sides of the vertical upper body fold line and each having a vertical length approximately equivalent to the interior diameter of the sleeve when the first vertical edge of the upper body is proximate the second vertical edge of the upper body;

wherein said lower edge of the upper body has a first arched groove above said first gusset portion and a second arched groove above said second gusset portion;

wherein said first gusset portion and said second gusset portion each has a part proximal the lower edge of the upper body and a part distal the lower edge of the upper body;

wherein said proximal part of said first gusset portion and said proximal part of said second gusset portion are each adapted to fold under or behind the lower edge of the upper body; and wherein said second gusset portion has a horizontal fold line between said proximal part of said second gusset portion and said distal part of said second gusset portion, and said distal part of said second gusset portion is adapted to fold under said proximal part of second gusset portion and to affix to the distal part of the first gusset portion to effect a hinge for opening and closing the sleeve, such that when the hinge is open, the gusset can lay flat or level beneath a beverage container inserted in the disposable beverage container sleeve, and when the hinge is closed the disposable beverage container sleeve can lay flat or substantially flat for use as a coaster for a beverage container;

wherein the distal part of the second gusset portion is affixed to the distal part of the first gusset portion with an adhesive along a glue line proximate and below the horizontal fold line of the second gusset portion.

2. The disposable beverage container sleeve of claim 1, wherein the upper body flap is affixed to the upper body with an adhesive.

3. The disposable beverage container sleeve of claim 1, wherein the upper body, the upper body flap, the first gusset portion, and the second gusset portion are provided in a unitary structure.

4. The disposable beverage container sleeve of claim 3, wherein the unitary structure is formed from a paper-based product.

5. The disposable beverage container sleeve of claim 4 wherein the paper-based product comprises cardboard or card stock.

6. The disposable beverage container sleeve of claim 4 wherein the paper-based product further comprises plastic, foil, absorbent, or combinations thereof.

7. The disposable beverage container sleeve of claim 1, further comprising a marketing logo incorporated in or on the upper body and/or the gusset, the marketing logo selected from the group consisting of logos: symbolizing an event, an association, an organization, a team, a school, a manufacturer, a producer, a supplier, a purveyor, or a cause; goods made or sold by a manufacturer, a producer, a supplier, or a purveyor; services provided by a manufacturer, a producer, a supplier, or a purveyor; and combinations thereof.

8. The disposable beverage container sleeve of claim 7, wherein the marketing logo is incorporated in or on the upper body and/or gusset by a process selected from the group consisting of imprinting, stamping, embossing, or affixing a label, and combinations thereof.

9. The disposable beverage container sleeve of claim 1, further comprising on both sides of and proximate to the vertical upper body fold line a first and a second vertical upper body pinch line or crease for making a fold-over flap to adjust the diameter of the sleeve.

10. A disposable beverage container sleeve, comprising:

a substantially rectangular upper body having a vertical upper body fold line and an integrated upper body flap along a full length of a first vertical edge of the upper body, the upper body flap adapted to fold under or behind a second vertical edge of the upper body, the upper body flap further adapted to be affixed to the upper body such that the first vertical edge of the upper body is proximate the second vertical edge of the upper body;

a gusset comprising a first gusset portion and a second gusset portion, the first and second gusset portions integrated with and depending from a lower edge of the upper body on opposing sides of the vertical upper body fold line and each having a vertical length approximately equivalent to the interior diameter of the sleeve when the first vertical edge of the upper body is proximate the second vertical edge of the upper body;

wherein said lower edge of the upper body has a first arched groove above said first gusset portion and a second arched groove above said second gusset portion;

wherein said first gusset portion and said second gusset portion each has a part proximal the lower edge of the upper body and a part distal the lower edge of the upper body;

wherein said proximal part of said first gusset portion and said proximal part of said second gusset portion are each adapted to fold under or behind the lower edge of the upper body; and wherein said second gusset portion has a horizontal fold line between said proximal part of said second gusset portion and said distal part of said second gusset portion, and said distal part of said second gusset portion is adapted to fold under said proximal part of second gusset portion and to affix to the distal part of the first gusset portion to effect a hinge for opening and closing the sleeve, such that when the hinge is open, the gusset can lay flat or level beneath a beverage container inserted in the disposable beverage container sleeve, and when the hinge is closed the disposable beverage container sleeve can lay flat or substantially flat for use as a coaster for a beverage container;

wherein the distal part of the second gusset portion is affixed to the distal part of the first gusset portion with an adhesive along a glue line in the distal part of the first gusset portion proximate to but below the proximal part of the first gusset portion.

11. The disposable beverage container sleeve of claim 10, wherein the upper body flap is affixed to the upper body with an adhesive.

12. The disposable beverage container sleeve of claim 11, wherein the upper body, the upper body flap, the first gusset portion, and the second gusset portion are provided in a unitary structure.

13. The disposable beverage container sleeve of claim 12, wherein the unitary structure is formed from a paper-based product.

14. The disposable beverage container sleeve of claim 13 wherein the paper-based product comprises cardboard or card stock.

15. The disposable beverage container sleeve of claim 13 wherein the paper-based product further comprises plastic, foil, absorbent, or combinations thereof.

16. The disposable beverage container sleeve of claim 10, further comprising a marketing logo incorporated in or on the upper body and/or the gusset, the marketing logo selected from the group consisting of logos: symbolizing an event, an association, an organization, a team, a school, a manufacturer, a producer, a supplier, a purveyor, or a cause; goods made or sold by a manufacturer, a producer, a supplier, or a purveyor; services provided by a manufacturer, a producer, a supplier, or a purveyor; and combinations thereof.

17. The disposable beverage container sleeve of claim 16, wherein the marketing logo is incorporated in or on the upper body and/or gusset by a process selected from the group consisting of imprinting, stamping, embossing, or affixing a label, and combinations thereof.

18. The disposable beverage container sleeve of claim 10 further comprising on both sides of and proximate to the vertical upper body fold line a first and a second vertical upper body pinch line or crease for making a fold-over flap to adjust the diameter of the sleeve.

* * * * *